US006084549A

United States Patent [19]

Pensjö et al.

[11] Patent Number: 6,084,549

[45] Date of Patent: Jul. 4, 2000

[54] RETRACTABLE TRIPOD ANTENNA

[75] Inventors: Tomas Pensjö, Jarfalla; Joacim Lundberg, Upplands Väsby, both of Sweden

[73] Assignee: Telefonaktiebolaget LM Ericsson, Stockholm, Sweden

[21] Appl. No.: 09/102,913

[22] Filed: Jun. 23, 1998

[30] Foreign Application Priority Data

Jun. 25, 1997 [SE] Sweden ..... 9702429

[51] Int. Cl.[7] ..... H01Q 1/24

[52] U.S. Cl. ..... 343/702; 343/880; 343/882; 248/180.1

[58] Field of Search ..... 343/702, 880, 343/881, 882, 765, 878, 883, 890, 829, 830, 846; 248/180.1, 181.1, 298, 516, 523

[56] References Cited

U.S. PATENT DOCUMENTS

| | | | |
|---|---|---|---|
| 2,284,434 | 5/1942 | Lindenblad . | |
| 2,445,336 | 7/1948 | Rauch . | |
| 4,543,584 | 9/1985 | Leer . | |
| 5,363,116 | 11/1994 | Allen | 343/881 |
| 5,575,438 | 11/1996 | McGonigle et al. | 244/13 |
| 5,614,918 | 3/1997 | Dinardo et al. | 343/882 |
| 5,749,549 | 5/1998 | Ashjaee | 248/168 |

FOREIGN PATENT DOCUMENTS

| | | |
|---|---|---|
| 0 075 374 | 3/1983 | European Pat. Off. . |
| 0 116 487 | 8/1984 | European Pat. Off. . |
| 0 387 445 | 9/1990 | European Pat. Off. . |
| 0 568 284 | 11/1993 | European Pat. Off. . |
| 1 518 575 | 7/1978 | United Kingdom . |

*Primary Examiner*—Don Wong
*Assistant Examiner*—Tho Phan
*Attorney, Agent, or Firm*—Burns, Doane, Swecker & Mathis, L.L.P.

[57] ABSTRACT

An antenna includes an aerial sheath, a body and legs pivotally attached to the body. The legs can be pivoted in the body from a storage position in which they are adjacent to the aerial sheath, to a working position in which they extend away from the body in a direction opposite that of the aerial sheath. The legs can support the antenna with the aerial sheath pointing upwards.

11 Claims, 2 Drawing Sheets

RETRACTABLE TRIPOD ANTENNA

BACKGROUND

The present invention relates to portable antennas for use with radio equipment and particularly to foldable antennas.

The use of portable radio receivers and transmitters has increased tremendously over the last few years. In particular there has been a large growth in the use of mobile telephones. This growth has been accompanied by a decrease in the size of mobile telephones and a corresponding decrease in the size of their built-in, internal antennas. These smaller antennas can prove inadequate in extreme conditions and when the telephone is used near to or connected to computer equipment EMC problems can occur. Therefore it is often desirable to connect the mobile telephone to a separate, external, antenna. These separate antennas are normally either magnetic foot antennas or ground plane independent desk antennas. Magnetic foot antennas require large conducting, magnetic ground planes to action which makes them large and heavy. Ground plane independent antennas are often half-wave dipoles which makes them tall and heavy. In order to be stable they need a commensurably large and heavy base which makes them even larger and heavier. These antennas often need an impedance matching network which leads to signal losses and lower antenna gain. The present invention seeks to provide a portable antenna which overcomes these problems.

SUMMARY

The present invention seek to provide an antenna which is lighter and less bulky than antennas previously used as external antennas.

The antenna according to the present invention comprises an aerial and three or more legs which are made of a conducting material and which are in electrical contact with the earth for the aerial wire. These legs are preferably movable in relation to the aerial so that they can form a stable base when the antenna is in use and they can reduce the bulkiness of the antenna by being folded up when the antenna is not in use. Preferably they are folded up alongside the aerial so that the total length of the antenna is reduced. When the antenna is in use the legs art folded out and project downwards at a angle from the aerial to form a stable tripod. The legs preferably comprise a ground plane for the antenna when they are folded out. By using the legs to form both the ground plane and a stable base for the antenna, there is a saving of both weight and space as there is no longer any need to provide a separate base and a separate ground plane.

BRIEF DESCRIPTION OF THE DRAWINGS

The invention will be illustrated by means of drawings of one example of an embodiment of the invention, in which.

DETAILED DESCRIPTION

Figure 1:
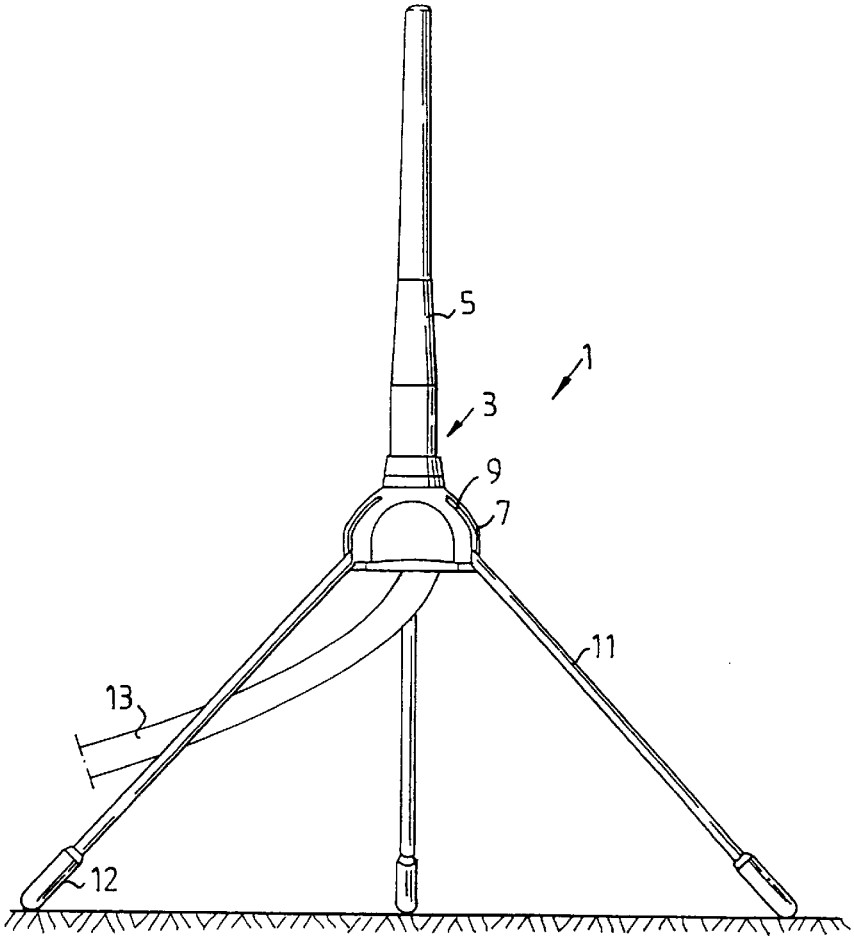
FIG. 1 is a side view of an embodiment of an antenna according to the invention.

In FIG. 1 a first embodiment of an antenna 1 according to the invention is shown in the folded out position. Antenna 1 has a body 3 which comprises an aerial sheath 5 on top of a leg housing 7. Body 3 is preferably made of an insulating, resilient material such as a plastic. The housing 7 has a substantially triangular horizontal cross-section and at each of the apexes of the triangle there is a hole 9. Each of these holes receives a leg 11 and the legs 11 are retained in the holes 9 by a pin or the like (not shown) which permit the legs 11 to rotate in the vertical plane. Legs 11 are made of a conducting material, preferably a metal such as copper, steel or aluminium. Legs 11 preferably have feet 12 made of an anti-slip material such as rubber. A coaxial antenna cable 13 is fitted into the body 3.

Figure 2:
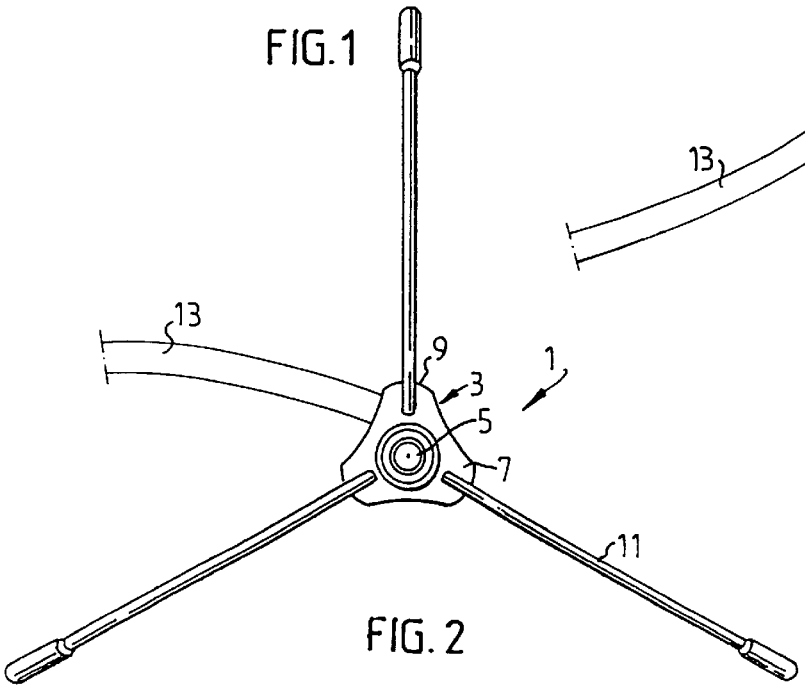
FIG. 2 is a plane view from above of the antenna according to FIG. 1.

FIG. 2 shows the antenna of FIG. 1 viewed from above.

Figure 3:
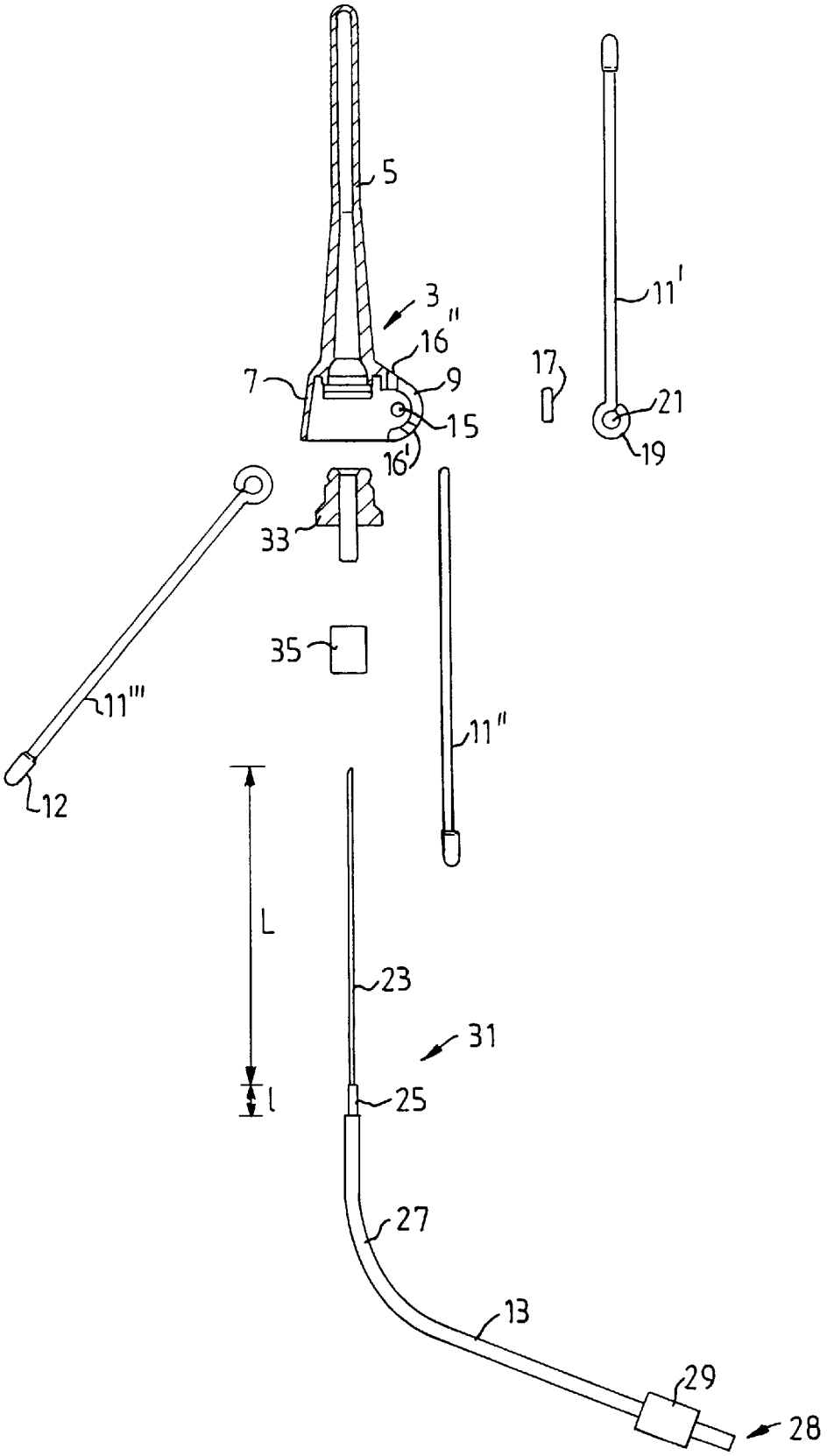
FIG. 3 is a partially sectioned exploded view of the antenna shown in FIG. 1.

FIG. 3 shows a vertical cross-section through body 3 though a hole 9. Hole 9 has a cavity 15 for receiving a horizontal retaining pin 17 for leg 11'. Leg 11' has one curved end 19 which forms a loop 21 which co-operates with pin 17 to retain leg 11' in hole 9. The fit between pin 15 and loop 21 is sufficiently loose to allow leg 11' to pivot around pin 15. Legs 11" and 11'" are similarly attached to body 3. The legs 11'-11'" can be individually moved in their respective holes 9 between a fully open position pointing downwardly inclined and a closed position in which they are adjacent to, and substantially parallel to, or inclined towards, the aerial sheath 5. The profile of the holes 9 can be adapted to include holding cut-outs 16', 16" such that when the legs 11'-11'" are placed in he fully open or closed positions they are retained there. In order to form a stable base for the antenna the legs should be able to be pivoted at least 90° from the closed position to the opened out position. Preferably the legs can be pivoted through a maximum angle which is in the range of 100°–160° from the closed position. Coaxial cable 13 comprises an insulated aerial wire 23 surrounded by an earth screen 25 which in turn is surrounded by an outer insulating cover 27. One end 28 of cable 13 is provided with a connector 29 for connecting it to a radio device (not shown). The other end 31 of cable 13 is partially stripped of earth screen 25 and outer insulating cover 27 to leave a suitable length of insulated aerial wire exposed to form an aerial of length L. The length L of aerial wire 23 exposed is adapted to the intended frequency range that the antenna 1 is to be used with. A preferably shorter length l of earth screen 25 is also exposed. The lengths L and l are chosen such that when the exposed aerial wire 23 is placed inside aerial sheath 5 the exposed earth screen 25 is at substantially the same height as holes 9. The coaxial cable is held in the leg housing 7 by a retaining body 33. Retaining body 33 can be attached to cable 13 by means of, for example, a crimping ring 35 being crimped onto the retaining body 33 after the cable 13 has been treaded though it. Retaining body 33 is fastened by any suitable means, such as snap-fitting, gluing, welding, screws, bolts rivets or the like to body 3. Retaining body 33 is made of a conducting material, or comprises conducting means, such that when it is fastened into body 3 it provided an electrically conducting path between legs 11'-11'" and earth screen 25. In this way the folded out legs 11'-11'" form a ground plane when the coaxial cable 13 is attached to a radio device. When used with a mobile telephone the length of the exposed aerial wire 23 of the antenna should preferably be between one eighth and one half of the wavelength of the frequency used and most preferably around one quarter of the wavelength e.g. around 8 cm long for a GSM system. The length of the legs 11 is preferably chosen that when they are folded up they do not extend beyond the end of the aerial sheath 5.

Figure 4:
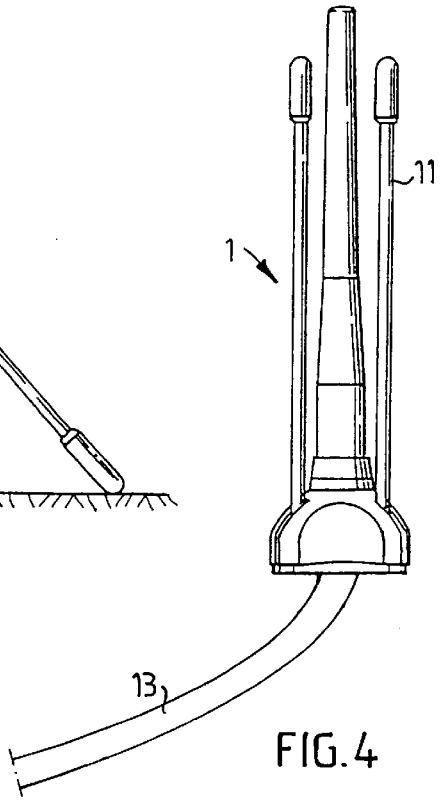
FIG. 4 is a side view of a folded antenna according to the invention.

FIG. 4 shows an antenna in a folded condition where legs 11'-11'" are substantially parallel to aerial sheath 5.

In another embodiment of the invention, not shown, the legs 11 are provided with magnetic feet to facilitate the use of the antenna on magnetic surfaces such as automobile bodies.

In yet another embodiment of the invention, not shown, legs 11 are telescopic.

In a further embodiment of the invention, not shown, leg 11 are helical.

In a further embodiment of the invention, not shown, the antenna comprises a helical aerial wire.

In a further embodiment, not shown, the aerial sheath is made of a conducting material, is telescopic or foldable and is electrically insulated from retaining body 33 and legs 11.

In a further embodiment of the invention the holes in which the legs are pivoted have friction means which resist movement of the legs so that once a leg has been placed in a particular position it is retained there until subject to a force greater than the force provided by the friction means. This enables the legs to be inclined at different angles with respect to the body of the antenna and therefore if the antenna rests on an uneven surface it is possible to adjust the positions of the legs so that the aerial is substantially vertical.

Although the invention has been illustrated by means of an antenna with a tripod arrangement of legs, it is also conceivable within the scope of the invention to vary the number of legs as required and it is also conceivable to have one or more legs which are not electrically conducting or which are not electrically connected to the earth screen of the aerial. It is also conceivable to provide a simplified antenna according to the invention which lacks a aerial sheath and body housing. In this case the legs could be conductingly attached to a conducting body which is also provided with means for non-conductingly supporting the aerial. It is naturally possible within the scope of the invention to combine any of the above-mentioned different embodiments of the legs, housing, retaining body, aerial wire, etc. in any conceivable manner.

What is claimed is:

1. Antenna for a portable radio apparatus comprising a body or housing means supporting an aerial wire and a plurality of legs, wherein said legs are movably attached to said body or housing means and are movable through an angle of at least 90° from a collapsed position adjacent to said aerial wire to a working position extending from said body or housing means in a direction away from said aerial wire and said legs support said antenna when said legs are in the working position.

2. Antenna according to claim 1, wherein said legs are movable from said collapsed position through a maximum angle which lies between 100° and 160°.

3. Antenna according to claim 1, wherein said antenna further comprises an earth screen and at least one of said legs is electrically conducting and electrically connected to said earth screen.

4. Antenna according to claim 3, wherein at least two of said legs are electrically connected to each other by electrically conducting retaining means which is electrically insulated from said aerial wire and electrically connected to said earth screen.

5. Antenna according to claim 1, wherein said legs are pivotally connected to said body or housing means.

6. Antenna according to claim 1, said antenna comprising at least three legs.

7. Antenna according to claim 1, wherein said legs have feet made of an anti-slip material.

8. Antenna according to claim 1, wherein said antenna is for a mobile telephone.

9. Ground plane for an antenna having a body or housing means supporting an aerial wire and an earth screen, said ground plane comprising legs, wherein said legs are movably attached to said body or housing means and are movable through an angle of at least 90° from a collapsed position adjacent to said aerial wire to a working position extending from said body or housing means in a direction away from said aerial wire and said legs support said antenna when said legs are in the working position.

10. Ground plane in accordance with claim 9, wherein said legs are movable from said collapsed position through a maximum angle which lies between 100° and 160°.

11. Ground plane according to claim 9, wherein at least one of said legs is electrically conducting and electrically connected to said earth screen.

* * * * *